United States Patent [19]

Drutchas

[11] 3,930,759

[45] Jan. 6, 1976

[54] INTEGRAL HOUSING PUMP WITH SERVO CONTROLLED CHEEK PLATE

[75] Inventor: Gilbert H. Drutchas, Birmingham, Mich.

[73] Assignee: TRW Inc., Cleveland, Ohio

[22] Filed: June 3, 1974

[21] Appl. No.: 475,784

[52] U.S. Cl. ..... 417/283

[51] Int. Cl.[2] ..... F04B 49/02

[58] Field of Search ..... 417/283

[56] References Cited

UNITED STATES PATENTS

| | | | |
|---|---|---|---|
| 2,755,741 | 7/1956 | Erskine | 417/283 |
| 2,818,813 | 1/1958 | Pettibone et al. | 417/283 |
| 3,671,143 | 6/1972 | Clark | 417/283 |
| 3,822,965 | 7/1974 | Drutchas | 417/283 |

*Primary Examiner*—Carlton R. Croyle
*Assistant Examiner*—Edward Look

[57] ABSTRACT

An integral housing type rotary positive displacement fluid flow device such as a power steering pump is provided with a servo valve sensitive to a pressure gradient on opposite sides of an orifice in the fluid flow path, controlling the unloading of a fluid pressure loaded cheek plate which unseats to directly bypass fluid from the outlet to the inlet in amounts exceeding the flow control set point and has an efficiently cored housing providing cavities for the components and passages connecting them in operative relation.

12 Claims, 4 Drawing Figures

INTEGRAL HOUSING PUMP WITH SERVO CONTROLLED CHEEK PLATE

BACKGROUND OF THE INVENTION

1. Field of the Invention

This invention relates to the art of rotary fluid displacement devices such as power steering pumps for automotive vehicles wherein flow control is accomplished with a small servo valve controlling a pressure loaded cheek plate and particularly deals with the coring of integral or cast housings for such devices to accommodate the flow control mechanism.

2. Description of the Prior Art

Heretofore known pumps with integral flow control valves required valve structure to bypass the full pump outlet to inlet and located the valve structure either exteriorly of the pump or as a package incorporated in passages in the pump housing or as a part of various components in a pumping cartridge. In all of these arrangements, flow through the valve at high flow rates produced high Bernoulli reaction forces that had to be offset by heavy springs so that the ports could be closed. These heavy springs increased flow orifice pressure drop, caused heat rise, and frequently required heat sinks or coolers to maintain the fluid at a safe temperature level.

SUMMARY OF THE INVENTION

In a copending U.S. Pat. application of myself and George A. Berman entitled, "Pumps with Servo Type Actuation for Cheek Plate Unloading", Ser. No. 303,115 filed Nov. 2, 1972, now U.S. Pat. No. 3,822,965 the disclosure of which is incorporated herein by reference, we have disclosed and claimed controlling flow in a pump by a pressure loaded cheek plate directly bypassing fluid from the outlet to the inlet which is in turn, controlled by a servo valve. In this pump, fluid is metered at discharge pressure into a static cavity behind the cheek plate. A pumping circuit which includes the pump outlet and pump inlet is provided with an orifice and the servo valve is actuated by pressure drop across the orifice to selectively vent the fluid behind the cheek plate, thereby unloading the plate to bypass fluid from the pump outlet to the pump inlet. In the pump of this application, the passageways connecting the chamber behind the cheek plate with the servo valve and the pump inlet are provided by a hollow dowel pin and registering orifices in a train or stack of pump components in a housing composed of an end head and a cup-shaped shell.

The present invention now eliminates the necessity for hollow dowel pins, registering ports in stacked pump components and the like and incorporates all of the required passages for the servo valve loading and unloading in an integral housing. This housing is generally cup-shaped with a closed end providing a support bearing for the driving shaft of the pump rotor and a cylindrical cavity receiving the train or stack of pump components and closed by a cup-shaped shell bottomed on the open end face of the housing and providing a fluid reservoir around the housing. The cheek plate may be mounted at the inboard or outboard end of the train or stack of pump components and the chamber for the servo valve and passages connecting the static chamber behind the cheek plate controlling the loading and unloading of the plate as the slave function of the master servo valve are formed in the housing without the aid of separate parts. The housing can be a cored metal casting requiring little or no machining. The open end of the housing is closed by a cup-shaped shell of stamped metal telescoped around the housing and providing a reservoir chamber therebetween. Thus, only a single casting and a single stamping provide a complete package for a reservoir and a pump with a servo control system having a servo valve operating as a master and a cheek or unloading plate operating as the slave and eliminating additional components to form conduits for flow of fluid to and from the valve and the static pressure loading chamber behind the cheek plate.

It is then an object of this invention to incorporate the master servo valve and the slave unloading cheek plate of the U.S. patent application Ser. No. 303,115 filed Nov. 2, 1972 U.S. Pat. No. 3,822,965 in an integral housing positive displacement device.

A further object of this invention is to provide an integral housing power steering pump for automotive vehicles with a servo valve controlled unloading plate to bypass fluid from the pump outlet to the pump inlet by unloading the plate whenever flow exceeds the flow control set point.

A specific object of the invention is to provide a compact integral housing power steering pump with cored passages in the housing accommodating the servo valve control of a cheek plate.

Another object of the invention is to provide a compact integral housing type power steering pump with internal cheek plate unloading controls without requiring additional components for passageways and the like.

Other and further objects of this invention will become apparent to those skilled in this art from the following detailed description of the annexed sheets of drawings which, by way of preferred examples only, illustrate two embodiments of the invention.

DESCRIPTION OF THE PREFERRED EMBODIMENTS

Figure 1:
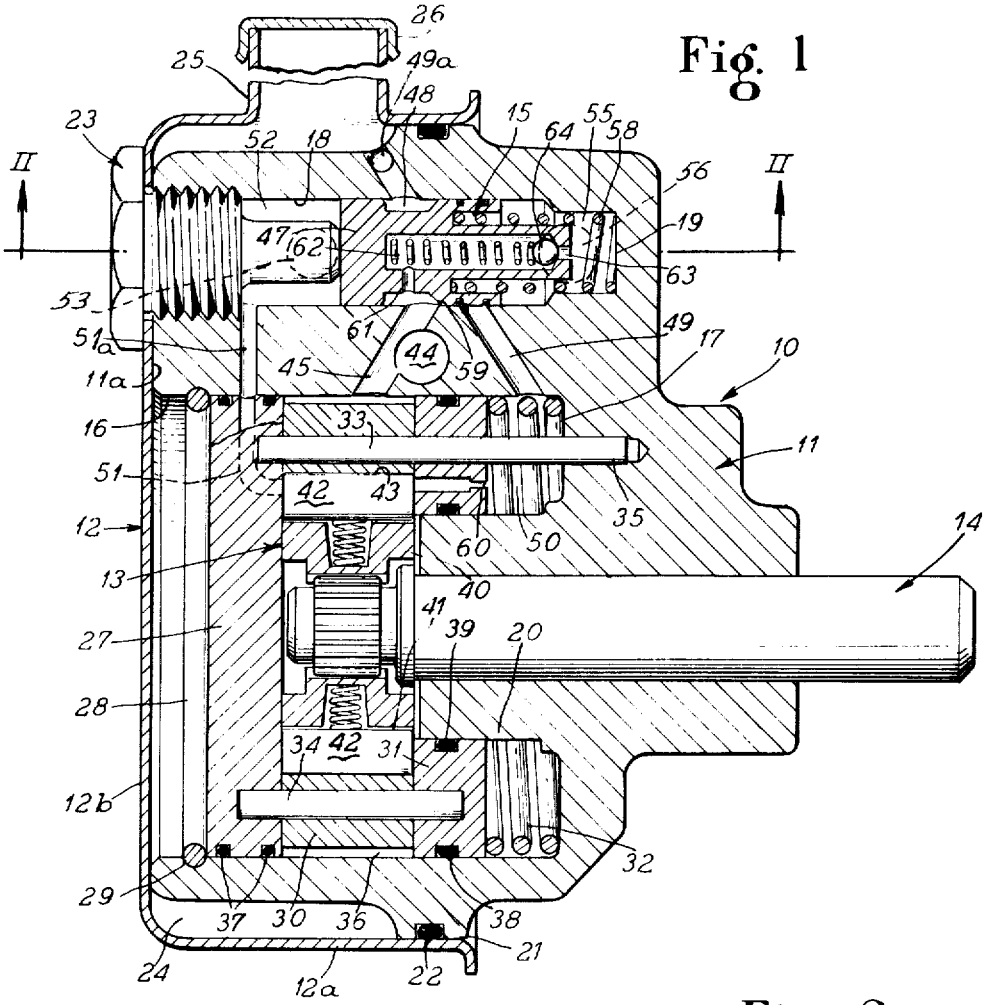
FIG. 1 is a longitudinal sectional view, with parts in elevation, of an integral housing pump according to this invention.
Figure 2:
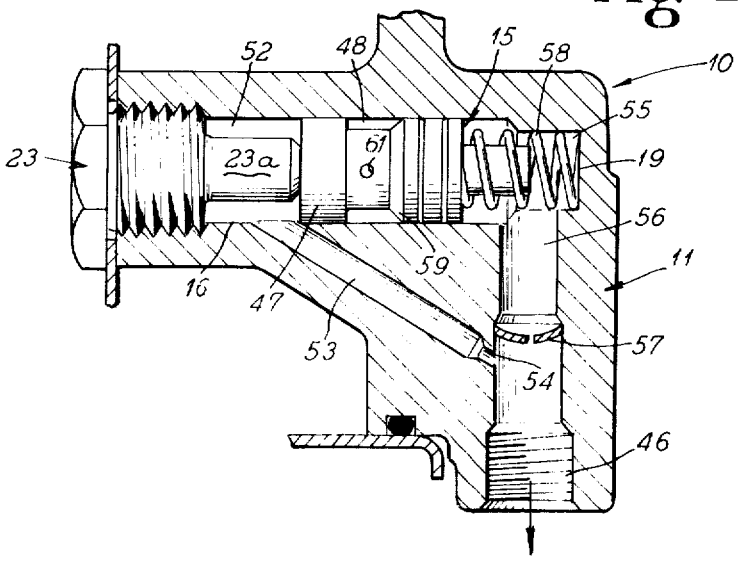
FIG. 2 is a cross sectional view along the line II—II of FIG. 1.

The pump 10 of FIGS. 1 and 2 includes an integral metal housing 11, preferably formed of cast iron or steel of generally cup-shape and cored to provide cavities and passageways for pump and valve components. A drawn steel cup-shaped shell 12 is telescoped over the open end of the cup-shaped housing 11 to close the end and form a reservoir around the housing 11. A train or stack 13 of pump components is mounted in the housing and the rotating parts of this train are driven by a shaft 14 rotatably mounted in the closed end of the housing and projecting therefrom. A servo valve 15 is also mounted in the housing to control pump flow as a function of pressure drop across an orifice.

The train or stack 13 of pump components is mounted in a large diameter cylindrical cavity 16 of the housing 11 extending inwardly from the open end of the housing to an end wall 17. A smaller diameter cylindrical cavity 18 also extends inwardly from the open end of the housing to an end wall 19 and rceives the servo valve 15. The cavity 16 has a boss portion 20 projecting into the center thereof from the end wall 17 to increase the bearing support for the shaft 14.

The housing 11 has a cylindrical raised land or pilot portion 21 with a groove receiving a sealing ring 22 and the cylindrical wall 12a of the shell 12 fits tightly around this land 21 and is sealed by the ring 22. The end 12b of the shell 12 is bottomed on the open end face 11a of the housing and held there by the head of a plug 23 which is threaded into the cavity 18. An annular reservoir 24 is thus provided around the periphery of the housing 11 covered by the shell 12. The shell has an upstanding neck 25 closed by a cap 26 providing a filling opening for the reservoir 24.

The train 13 of pump components in the housing cavity 16 includes a lower or outboard plate 27 restrained in the cavity by a snap ring 28 locked in a groove 29 in the mouth of the cavity 16, a cam ring or pump stator 30, an upper or inboard unloading plate 31, and a coil spring 32 compressed between the plate 31 and the bottom 17 of the cavity. A set of dowel pins 33 and 34 hold the train components in registration with one of the dowel pins 33 anchored in a hole 35 of the housing 11 to hold the components against rotation in the housing.

The cam ring 30 is of smaller diameter than the bore 16 and an annular chamber 36 is provided around the cam ring 30 between the plates 27 and 31.

The plate 27 has a cylindrical periphery slidable in the cavity 16 and grooved to receive seal rings 37. The plate 31 is annular with a cylindrical outer periphery also sliding in the cavity 16 and with an inner cylindrical periphery sliding on the boss 20. The outer periphery is grooved to receive a seal ring 38 and the inner periphery is grooved to receive a seal ring 39. The spring 32 urges the stack or train 13 of components against the snap ring 28 and thus loads the unloading plate 31 against the cam ring 30.

The cam ring surrounds a pump rotor 40 splined to the shaft 14 and having circumferentially spaced pockets 41 around the periphery thereof slidably supporting spring loaded slippers 42 which ride on the inner elliptical periphery 43 of the cam ring and provides the pumping chamber for the slipper pump.

Fluid from the reservoir 24 flows through cored passages 44 and 45 to fill the chamber 36 and flows through ports (not shown) in the unloading plate 31 to the intake side of the pumping chamber or chambers of the pump and is discharged through ports and passages (not shown) to the pump outlet 46.

The servo valve 15 has a spool body 47 slidable in the cavity 18 with a groove 48 therearound adapted to selectively register with the passage 45 and a core passage 49 communicating with a chamber 50 surrounding the boss 20 behind the unloading plate 31. As shown, the passage 49 extends beyond the cavity 18 to the outside of the housing 11 but is sealed at its outer end with a pressed-in or welded-in metal ball 49a. This makes for an easy coring of a passage sloping from the bottom of the cavity 16 toward the mouth of the cavity.

Flow emanating from the pump outlet port (not shown) flows through a cored passage 51 in the plate 27 and through a channel 51a in the housing 11 to a chamber 52 in the cavity 18 between the valve 47 and the plug 23. From this chamber 52, as shown in FIG. 2, the fluid flows through a cored passageway 53 and through an orifice 54 to the outlet 46.

A chamber 55 at the end 19 of the cavity registers with a cored passage 56 to the outlet 46. An orifice disk 57 is provided in this passage 56 upstream from the orifice 54.

A spring 58 in the chamber 55 bottomed on the end wall 19 of the cavity 16 urges the spool valve body 47 against the pin end 23a of the plug 23. The valve body 47 has a chamfer 59 at the right-hand end of the groove 48 and when pressure in the chamber 52 shifts the valve body to the right against the bias of the spring 58, the passage 49 will be uncovered to vent the chamber 50 behind the unloading plate 31 to the valve groove 48. The chamber 50 is filled with fluid from the pressure side of the pump through an orifice 60. The groove 48 communicates through an orifice 61 with a bore 62 in the body 47 and an orifice 63 connects this bore 62 with the chamber 55. A spring loaded ball 64 in the bore 62 closes the orifice 63. By this arrangement, when pressure in the chamber 55 acting on the ball 64 exceeds the force of spring 62, the ball 64 will be unseated to bleed fluid from the chamber 55 into the inlet passage 45.

As pressure in the cavity 52 builds up beyond a desirable level, the valve body 47 will be shifted to the right so that the chamfer 59 will uncover the passage 49 to vent fluid from the chamber 50 to the inlet passage 45, thus, unloading the plate 31 and permitting it to unseat from the cam ring 30 to directly bypass fluid from the outlet to the inlet of the pump. Further motion of the spool valve body 47 due to rising flow will open the chamber 52 to the passage 45.

Thus, pressure relief is accomplished when pressure rising in chamber 55 forces the ball 64 off of its seat momentarily thereby dropping pressure in the chamber 55 and causing the valve to move to the right to unload the plate 31 and accomplish the bypass function. A supercharge effect is accomplished by flow of fluid through the bypass passage 45 which interfaces with the intake hole 44 at a convenient oblique angle to aspirate fluid into the passage 45.

From the above description it will be understood that pressure in the pump outlet 46 is limited as it approaches the preset setting of the ball 64 and spring 62. When this pressure exceeds a predetermined maximum, the ball 64 will be unseated opening up orifice 63 for connecting the chamber 55 through the bore 62 and port 61 of the spool valve body 47 with the inlet passage 45 whereupon pressure in the chamber 52 will be greater than the pressure in the chamber 55 and the spool valve body 47 will be shifted to the right to vent the chamber 50 behind the unloading plate 31 with the inlet 45. Thus, the servo valve 15 acts as a master to control the slave unloading plate 31.

Figure 3:
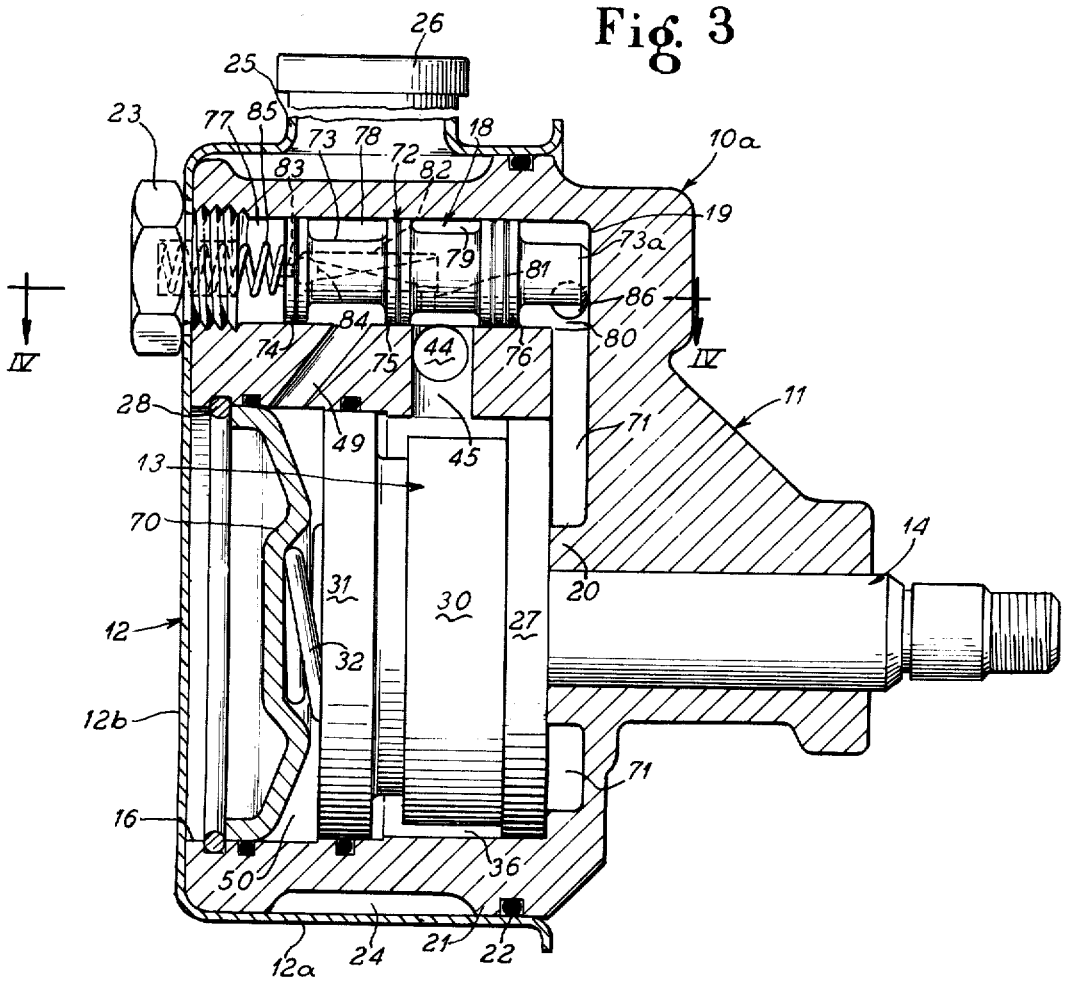
FIG. 3 is a view similar to FIG. 1 but illustrating another embodiment of the invention.
Figure 4:
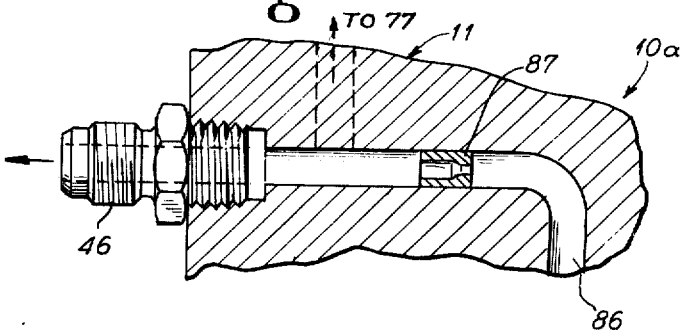
FIG. 4 is a cross section taken generally along the line IV—IV of FIG. 3.

In the modification **10*a* of FIGS. 3 and 4, parts substantially identical with parts described in FIGS. 1 and 2** have been marked with the same reference numerals.

In FIG. 3, the unloading plate 31 is positioned at the outboard end of the cavity 16 and the spring 32 rests on a disk 70 in the cavity restrained by the snap ring 28. Outlet ports 71 in the housing behind the plate 27 communicate with the cavity 18 at the end 19 thereof. This cavity 18 slidably mounts a modified spool valve 72 with a body 73 having lands 74, 75, and 76 riding on the cylindrical wall of the cavity and isolating an end chamber 77, a groove chamber 78, a second groove chamber 79, and an opposite end chamber 80. The chamber 77 is vented to the end chamber 79 through a port 81, a bore 82 and an end orifice 83 controlled by a spring loaded ball 84.

A spring 85 resting in a cavity face in the plug 23 urges the nose end 73a of the valve body 73 against the end wall 19 of the cavity 18.

In the position illustrated in FIG. 3, the annular chamber 79 registers with the inlet 44 while the annular chamber 78 registers with the passageway 49 to the static loading chamber 50 behind the unloading plate 31.

The chamber 80 is vented to the outlet 46 through a cored passage 86 containing an orifice 87 determining the set flow rate for the pump. A passage, analogous to passage 56 of FIG. 2 is provided for communication between chamber 77 and the downstream side of orifice 87

When the flow rate exceeds the set point, the valve 72 is shifted to the left moving valve chamfer into a bias position connecting static cavity 50 with cavity 18 through passage 49 and cavity 78, thus unloading plate 31 and sustaining a flow control action. A similar action ensues in pressure relief. On reaching a predetermined pressure setting, pressure in the chamber 77 will momentarily unseat the ball 84, venting the fluid to the inlet 44 so that the pressure in the chamber 80 will shift the valve to the left against the bias of the spring 85 venting the passage 49 to the inlet 44 and relieving pressure in the chamber 50 thereby permitting the unloading plate 31 to be unseated from its sealing position and communicate the outlet and inlet ports. The pump 10a thus operates in the same manner as the pump 10 with the servo valve 72 acting as a master to control the slave unloading plate 31.

From the above descriptions it should, therefore, be understood that this invention provides an integral housing type rotary positive displacement pump especially suited for automotive power steering usage where the housing provides cavities and passageways accommodating operation of a flow control master servo valve controlling a slave unloading plate to directly bypass fluid from the pump outlet to the pump inlet whenever pump flow rate exceeds a predetermined amount. The invention eliminates heretofore required additional pump components, tubing and the like.

I claim as my invention:

1. A positive displacement pump which comprises a one-piece housing having an outlet and first and second cavities open at one end, a train of pump components in the first cavity including a cam ring defining an interior pumping chamber with inlet and outlet sides, a rotor carrying pumping means riding in the cam ring and a fluid pressure loaded cheek plate pressed against one side of the cam ring, said first cavity providing a static fluid pressure chamber behind said cheek plate, servo valve components in the second cavity, a shaft rotatably carried by the housing coupled to said rotor, a cup-shaped shell telescoped over the housing closing the open end thereof and providing a fluid reservoir around the housing, and passages in said housing from the reservoir to the inlet side of the pumping chamber and from the outlet side of the pumping chamber to the outlet, an orifice in the passage to the outlet, and passages in the housing from the upstream side of said orifice to the second cavity, from the inlet side of the pumping chamber to the second cavity and from the static fluid pressure chamber to the second cavity whereby the servo valve is sensitive to pressure drop on opposite sides of the orifice and controls the unloading of the cheek plate and all components in the housing are placed in operating fluid communication by housing passages.

2. The pump of claim 1 wherein the cheek plate is positioned in the inboard end of the first cavity.

3. The pump of claim 1 wherein the cheek plate is positioned in the outboard end of the first cavity.

4. The pump of claim 3 including a cover plate closing the outboard end of the first cavity and cooperating therewith to form a static fluid chamber behind the cheek plate.

5. The pump of claim 1 wherein the pumping means riding in the cam ring are spring loaded slippers.

6. The pump of claim 1 wherein the train of pump components is bottomed on a snap ring in the first cavity.

7. The pump of claim 1 including an additional passage connecting the second cavity to the downstream side of the orifice to aspirate fluid from the second cavity.

8. An integral housing slipper pump adapted for automotive power steering gear having a servo valve controlling an unloading plate to bypass fluid for controlling pump flow output which comprises a housing with a large cavity and an adjacent smaller cavity, said cavities opened at one end of the housing and closed at the other end of the housing, a shell telescoped over said one end of the housing closing both cavities and forming a reservoir around the housing, a shaft rotatably supported by said housing, a train of pump components in said large cavity of the housing including a cam ring, end plates bottomed on both sides of the cam ring, a rotor coupled to said shaft having fluid displacement means riding in said cam ring, and a spring biasing one of said end plates against the cam ring, said large cavity having a static fluid chamber behind said spring biased end plate, a servo valve slidable in said small cavity, and core passages in said housing joining the cavities to direct fluid for shifting the servo valve to control the unloading of fluid from the static chamber and thereby permit the spring loaded end plate to unseat from the cam ring for directly bypassing fluid from the inlet to the outlet sides of the cam ring.

9. The slipper pump of claim 8 wherein the servo valve has a spring loaded cheek valve for relieving fluid from one end of the servo valve.

10. The slipper pump of claim 8 wherein the servo valve is a spool valve, has an axial bore vented to the periphery thereof intermediate the ends thereof and has a spring loaded ball closing the mouth of the bore.

11. The slipper pump of claim 8 including a cylindrical boss projecting into the central portion of the large cavity and an annular cheek plate riding on said boss.

12. The slipper pump of claim 8 wherein the housing is a metal casting and the cavities and passages are formed in the casting.

* * * * *